US008385755B2

(12) United States Patent
Hyun et al.

(10) Patent No.: US 8,385,755 B2
(45) Date of Patent: Feb. 26, 2013

(54) FIXING DEVICE HAVING A UNIT TO PREVENT OVERHEATING

(75) Inventors: Ho Ill Hyun, Hwaseong-si (KR); Kwon Ho Yoon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 424 days.

(21) Appl. No.: 12/632,064

(22) Filed: Dec. 7, 2009

(65) Prior Publication Data

US 2010/0142978 A1 Jun. 10, 2010

(30) Foreign Application Priority Data

Dec. 9, 2008 (KR) ..... 2008-124608

(51) Int. Cl.
*G03G 15/20* (2006.01)

(52) U.S. Cl. ..... 399/33

(58) Field of Classification Search ..... 399/33, 399/69, 328, 330, 335; 219/216, 482, 485, 219/510, 517
See application file for complete search history.

(56) References Cited

U.S. PATENT DOCUMENTS

| | | | | |
|---|---|---|---|---|
| 4,794,364 | A * | 12/1988 | Uehara | 337/354 |
| 5,737,664 | A * | 4/1998 | Fukuda et al. | 399/33 |
| 7,009,153 | B2 * | 3/2006 | Tomatsu | 219/494 |
| 8,041,260 | B2 * | 10/2011 | Yoshida | 399/122 |
| 2002/0057919 | A1 | 5/2002 | Tomatsu | |

FOREIGN PATENT DOCUMENTS

| | | | |
|---|---|---|---|
| JP | 58158673 | A * | 9/1983 |
| JP | 63095485 | A * | 4/1988 |
| JP | 02217877 | A * | 8/1990 |
| JP | 02309381 | A * | 12/1990 |
| JP | 03204675 | A * | 9/1991 |
| JP | 05002355 | A * | 1/1993 |
| JP | 08234619 | A * | 9/1996 |
| JP | 2007240791 | A * | 9/2007 |

* cited by examiner

*Primary Examiner* — Robert Beatty
(74) *Attorney, Agent, or Firm* — Stanzione & Kim, LLP

(57) ABSTRACT

A fixing device and an image forming apparatus having the same, and a method of operating the fixing device, the fixing device being provided with a power interruption unit to prevent overheating of the fixing device by physically separating a fuse element from a power line and/or approximating a thermostat to a fixing member of the fixing device.

19 Claims, 12 Drawing Sheets

FIXING DEVICE HAVING A UNIT TO PREVENT OVERHEATING

CROSS-REFERENCE TO RELATED APPLICATIONS

This application claims the benefit under 35 U.S.C. §119 (a) of Korean Patent Application No. 2008-0124608, filed on Dec. 9, 2008, in the Korean Intellectual Property Office, the disclosure of which is incorporated herein by reference in its entirety.

BACKGROUND

1. Field of the Invention

Embodiments of the present general inventive concept relate to a fixing device having improved safety against overheating and an image forming apparatus having the same.

2. Description of the Related Art

Generally, an image forming apparatus is provided with a fixing device which heats a paper having a powdery toner image transferred thereon so that the toner image is temporarily fused and thereby fixed onto the paper. The fixing device typically comprises a fixing roller that fixes the toner image to the paper, and a pressing roller that supports and presses the paper against the fixing roller. The fixing roller typically includes a heating lamp mounted through the inner center thereof to heat the fixing roller with radiant heat from the heating lamp.

A thermistor, which contacts an outer circumference of the fixing roller and measures a surface temperature of the fixing roller, and a thermostat, which interrupts power being supplied to the heating lamp when the surface temperature of the fixing roller exceeds a predetermined threshold, are typically installed at one side of the fixing roller. The thermistor transmits the measurement result to a controller (such as a microcomputer) of the image forming apparatus, and the controller switches a switching element based on the measured temperature, thereby controlling power supplied to the heating lamp so that the surface temperature of the fixing roller can be maintained within a certain range. When the surface temperature is higher than the predetermined threshold, the thermostat interrupts the power supply to the heating lamp by opening an internal terminal.

However, conventionally, if an A/D port of the controller begins to perform erratically due to certain external factors such as static electricity, a voltage may be continuously applied by the A/D port. If the switching element is kept on continuously due to a short circuit, on and off states of the heating lamp may not be normally controlled. In such cases, the fixing roller is overheated because the AC power is continuously applied to the heating lamp until the surface temperature of the fixing roller is increased to over the predetermined threshold and the internal terminal of the thermostat is opened. Accordingly, peripheral parts including the fixing roller may be melted or damaged by the high temperature.

SUMMARY

Example embodiments of the present general inventive concept provide a fixing device capable of improving safety thereof by promptly and securely interrupting power supply applied to a heating lamp when overheated, and an image forming apparatus having the same.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a fixing device including a fixing member including a heating source, a fuse element connected to a power line interconnecting the heating source and a main power, a thermostat serially connected to the fuse element through the power line to be turned on and off according to a temperature of the fixing member, and a power interruption unit to separate the fuse element from the power line and move the thermostat toward the fixing member so that power supplied to the heating source is interrupted in response to the fixing member being overheated.

The power interruption unit may include a cover member including an elastic member compressed by the thermostat, an actuator including a reciprocal piston, and a supporting member to allow the thermostat to move toward the fixing member and to separate the fuse element from a fuse holder in association with movement of the piston.

The supporting member may include a connecting unit to connect to the piston, a first supporting unit to support the thermostat so as to hinder movement of the thermostat, and a second supporting unit to partially enclose and support the fuse element.

The fixing device may further include a temperature sensor to sense the temperature of the fixing member, and the power interruption unit may include a driving unit to operate the actuator in accordance with output signals from the temperature sensor.

The driving unit may include a comparator to compare a voltage output by the temperature sensor to a preset reference voltage, and a switching element to switch the power supplied to the actuator on and off in accordance with output signals from the comparator.

The foregoing and/or other features and utilities of the present general inventive concept may also be achieved by providing a fixing device including a fixing member including a heating source, a thermostat connected to a power line interconnecting the heating source and a main power to be turned on and off according to a temperature of the fixing member, and a power interruption unit to move the thermostat toward the fixing member in response to the fixing member being overheated so that power supplied to the heating source is interrupted.

The foregoing and/or other features and utilities of the present general inventive concept may also be achieved by providing a fixing device including a fixing member including a heating source, a fuse element connected to a power line interconnecting the heating source and a main power, and a power interruption unit to separate the fuse element from the power line in response to the fixing member being overheated, so that power supplied to the heating source is interrupted.

The foregoing and/or other features and utilities of the present general inventive concept may also be achieved by providing an image forming apparatus including a photoconductive medium on which to form an electrostatic latent image, a developing device to develop the electrostatic latent image on the photoconductive medium into a visible image using a developer, a transfer device to transfer the visible image to a recording medium, a fixing device to fix the visible image transferred on the recording medium, and a power interruption unit to interrupt power being supplied to the fixing device, wherein the fixing device may include a fixing member having a heating source, and a thermostat connected to a power line interconnecting the heating source and a main power to be turned on and off according to temperature of the fixing member, and the power interruption unit may move the thermostat toward the fixing member in response to the fixing member being overheated, so that power supplied to the heating source is interrupted.

The image forming apparatus may further include a fuse element connected to the power line between the heating source and the main power, and the power interruption unit may move the thermostat toward the fixing member and separate the fuse element from the power line so that the power supplied to the heating source is interrupted.

The power interruption unit may include a cover member including an elastic member compressed by the thermostat, an actuator including a reciprocal piston, and a supporting member to allow the thermostat to move toward the fixing member and to separate the fuse element from a fuse holder in association with movement of the piston.

The supporting member may include a connecting unit to connect to the piston, a first supporting unit to support the thermostat so as to hinder movement of the thermostat, and a second supporting unit to partially enclose and support the fuse element.

The fixing device may include a temperature sensor to sense the temperature of the fixing member, and the power interruption unit may include a driving unit to operate the actuator in accordance with output signals from the temperature sensor.

The driving unit may include a comparator to compare a voltage output by the temperature sensor to a preset reference voltage, and a switching element to switch the power supplied to the actuator on and off in accordance with output signals from the comparator.

The foregoing and/or other features and utilities of the present general inventive concept may also be achieved by providing a fixing device including a fixing member having a heating source, a thermostat to control power supplied to the heating source, and a movement unit to move the thermostat with respect to the fixing member in response to detecting a predetermined temperature of the fixing device.

The fixing device may further include a driving circuit to drive the movement unit independently of a controller of an image forming device in which the fixing device is provided.

The driving circuit may include a comparator to compare a voltage received from a temperature detector with a reference voltage, and a switching element to drive the movement unit according to results received from the comparator.

The fixing device may further include a fuse element provided in a power line connected to the heating source, and the movement unit may disconnect the fuse element from the power line in response to detecting the predetermined temperature of the fixing device.

The movement unit may selectively move the thermostat closer to and farther away from the fixing member.

The foregoing and/or other features and utilities of the present general inventive concept may also be achieved by providing a fixing device including a fixing member having a heating source, a fuse element provided in a power line connected to the heating source, and a movement unit to disconnect the fuse element from the power line in response to detecting a predetermined temperature of the fixing device.

The movement unit may disconnect the fuse element by removing the fuse element from the power line.

The foregoing and/or other features and utilities of the present general inventive concept may also be achieved by providing a method of controlling a temperature of a fixing device, the method comprising sensing the temperature of the fixing device, and moving a thermostat in the fixing device with respect to a fixing roller in the fixing device according to the temperature having a predetermined value so that the thermostat terminates power supplied to the fixing roller.

The method may further include disconnecting a fuse element from a power line supplying the power to the fixing roller in response to the temperature having the predetermined value.

The movement unit may selectively move the thermostat closer to and farther away from the fixing member.

The foregoing and/or other features and utilities of the present general inventive concept may also be achieved by providing a method of controlling a temperature of a fixing device, the method including sensing the temperature of the fixing device, and disconnecting a fuse element from a power line supplying power to a fixing roller of the fixing device in response to the temperature having a predetermined value.

The fuse element may be disconnected by removing the fuse element from the power line.

As described above, the fixing device according to various embodiments of the present general inventive concept may be provided with a power interruption unit capable of interrupting power supplied to a heating source of a fixing member, in a case in which the fixing device is overheated, independently from the control of a fixing temperature. In the power interrupting unit, a fuse element may be physically separated from a power line, a thermostat may be approximated to the fixing member, or both features may be present. Therefore, in a case in which the fixing device is overheated, power supplied to the heating source may be promptly and securely interrupted before deformation or damage of peripheral parts is incurred. Thus, the safety of the fixing device may be improved.

BRIEF DESCRIPTION OF THE DRAWINGS

These and/or other features and advantages of the present general inventive concept will become apparent and more readily appreciated from the following description of the embodiments, taken in conjunction with the accompanying drawings of which.

DETAILED DESCRIPTION OF THE EMBODIMENTS

Figure 1:
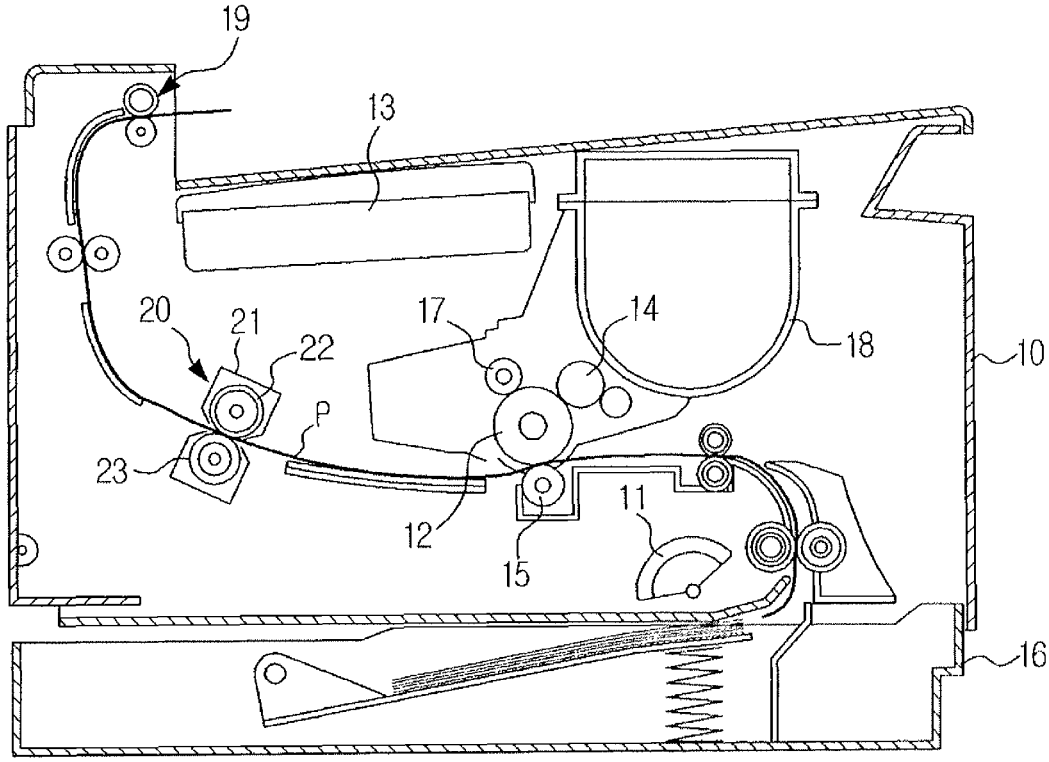
FIG. 1 is a sectional view schematically illustrating an image forming apparatus according to an embodiment of the present general inventive concept.

Reference will now be made in detail to various embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a sectional view schematically illustrating an image forming apparatus according to an embodiment of the present general inventive concept.

Referring to FIG. 1, the image forming apparatus may include a main body 10 to provide an exterior appearance, a pickup device 11 to pick up a recording medium sheet by sheet, a photoconductive medium 12 whereon an electrostatic latent image may be formed, an exposing device 13 to emit light corresponding to an image signal to the photoconductive medium 12, a developing device 14 to develop the electrostatic latent image formed on the photoconductive medium 12 into a visible image using a developer, a transfer device 15 to transfer the visible image formed on the photoconductive medium 12 to the recording medium, and a fixing device 20 to fix the visible image to the recording medium. The image forming apparatus may also include a stacking device 16 to stack the recording medium therein, an electrifying device 17 to electrify the photoconductive medium 12 to a predetermined potential, a developer storage 18 to store therein the developer, and a discharging device 19 to discharge the recording medium on which the image is printed. Additionally, although not illustrated, the image forming apparatus may further include a driving source generating a driving force, a power supply device supplying electric power, and a control device controlling the overall operations of the image forming apparatus.

Upon starting of a printing operation, the pickup device 11 may be operated to pick up the recording medium stacked in the stacking device 16 sheet by sheet and feed the picked up recording medium to the photoconductive medium 12. The exposing device 13 may emit light corresponding to the image signal to a surface of the photoconductive medium 12 that may be electrified to a predetermined potential by the electrifying device 17, thereby forming the electrostatic latent image. Developer may be applied to the photoconductive medium 12 by the developing device 14 so that the electrostatic latent image becomes a visible image formed of a powdery developer on the photoconductive medium 12. The visible image may be transferred to a surface of the recording medium by the transfer device 15 and fixed to the surface as the recording medium passes through the fixing device 20. The recording medium printed with the image may be discharged from the main body 10 by the discharging device 19.

As described above, the printing processes may be performed as typically performed in general electrophographic image forming apparatuses. In various embodiments of the present general inventive concept described herein, aside from the fixing device 20, the other component parts may be the same as, or similar to, those provided in general image forming apparatuses. Therefore, the image forming apparatus according to various embodiments of the present general inventive concept will be explained in the following descriptions, and detailed description about components other than the fixing device 20 may be omitted.

Figure 2:
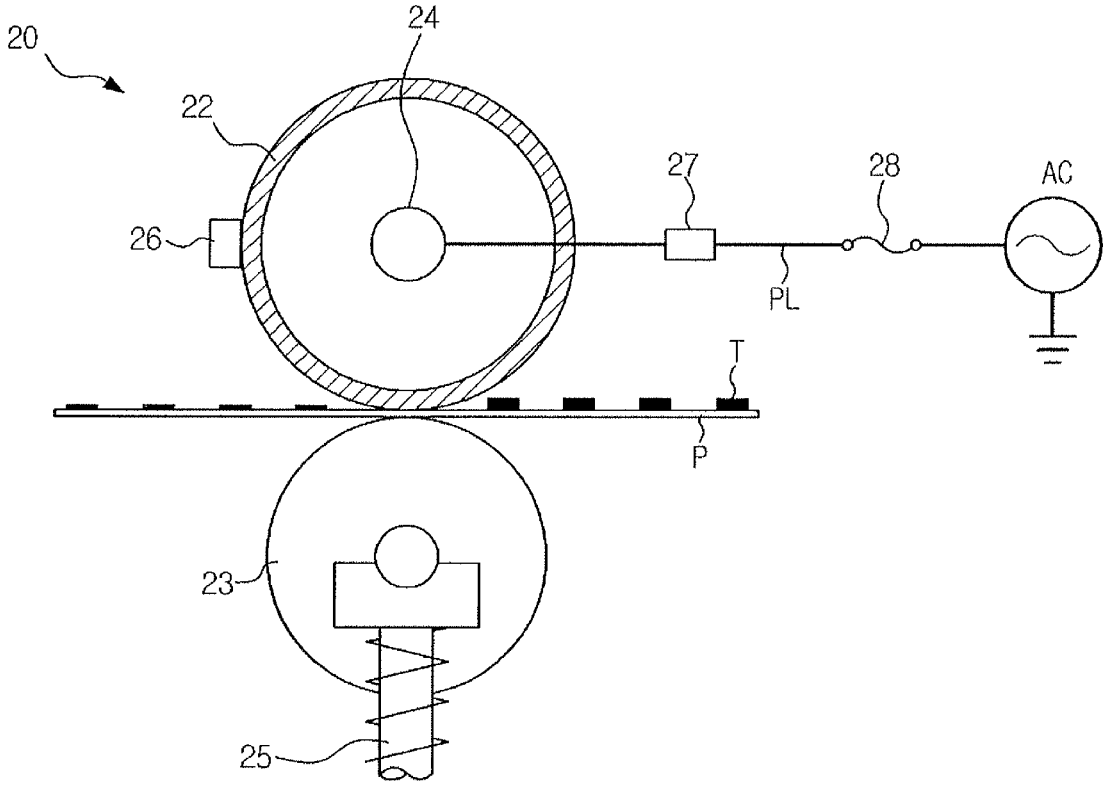
FIG. 2 illustrates the structure of a fixing device of the image forming apparatus according to an embodiment of the present general inventive concept.

FIG. 2 illustrates the structure of a fixing device of the image forming apparatus according to an embodiment of the present general inventive concept.

Referring to FIG. 2, the fixing device 20 may include a fixing device frame 21 including therein a fixing roller 22 to fix the developer onto the recording medium P and a pressing roller 23 to support and press the recording medium P against the fixing roller 22.

The fixing roller 22 may include a heating lamp 24, for example a halogen lamp, as a heating source provided through the inner center thereof. The heating lamp 24 may generate heat in the fixing roller 22, and the fixing roller 22 may therefore be heated by a radiant heat from the heating lamp 24.

The pressing roller 23 may be disposed at a lower part of the fixing roller 22 to face the fixing roller 22 with respect to the recording medium P. The pressing roller 23 may be elastically supported by a spring 25 (or any similar elastically biasing member), thereby biasing the recording medium P passing between the fixing roller 22 and the pressing roller 23 toward the fixing roller 22 by a predetermined pressure. While the recording medium P is passing between the fixing roller 22 and the pressing roller 23, the visible image T in the powder state transferred on the recording medium P may be fixed to the surface of the recording medium P by heat and pressure.

At one side of the fixing roller 22, there may be installed a thermistor 26 to measure a surface temperature of the fixing roller 22. The thermistor 26 may transmit the measurement result to a controller, e.g., a processor, microcomputer, etc., of the image forming apparatus, and the controller may control the power supplied to the heating lamp 24 so that the surface temperature of the fixing roller 22 can be maintained within a certain range.

At the other side of the fixing roller 22, a thermostat 27 may be provided to interrupt the power supply to the heating lamp 24 in response to the surface temperature of the fixing roller 22 exceeding a predetermined threshold. The thermostat 27 may be disposed on a power line PL interconnecting a main power AC and the heating lamp 24. The thermostat 27 may be a thermal switch operating in such a manner that an internal terminal causes a short circuit (or closed connection) in response to an inner temperature being lower than a predetermined threshold, and is opened in response to the inner temperature being greater than the threshold. When the surface temperature of the fixing roller 22 is lower than the predetermined threshold, the internal terminal of the thermostat 27 may maintain the short circuit so that the AC power is applied to the heating lamp 24. When the surface temperature is higher than the predetermined threshold, the thermostat 27 may interrupt the AC power supplied to the heating lamp 24 by opening the internal terminal. In a case in which the surface temperature of the fixing roller 22 is not properly controlled by the thermistor 26 or the controller and therefore the surface temperature of the fixing roller 22 becomes higher than the predetermined threshold, the thermostat 27 is able to interrupt the AC power current to the heating lamp 24 by opening the internal terminal.

The fixing device 20 may further include a fuse element 28 provided to the power line L between the main power AC and the thermostat 27. The fuse element 28 may be serially connected to the thermostat 27 and may be melted by heat in case of overcurrent or inrush current, so that the AC power supplied to the heating lamp 24 is interrupted.

As described above, the surface temperature of the fixing roller 22 may be maintained within a predetermined range by the controller which controls the power supply to the heating lamp 24 by switching on and off a switching element according to the surface temperature of the fixing roller 22 measured by the thermistor 26. However, when an A/D port of the controller becomes uncontrollable owing to certain external factors such as static electricity, a voltage may be continuously applied by the A/D port. When the switching element is continuously switched on due to a short circuit, on and off states of the heating lamp 24 may not be normally controlled. In such cases, overheating of the fixing roller 22 may occur because the AC power is continuously applied to the heating lamp 24 until the surface temperature of the fixing roller 22 is increased to over the predetermined threshold and the internal terminal of the thermostat is therefore opened. Accordingly, peripheral parts including the fixing roller 22 may be melted or damaged by the high temperature.

To this end, according to this embodiment of the present general inventive concept, a power interruption unit may be provided to interrupt the power supply to the heating lamp 24 in a case in which the fixing device 20 is overheated. The power interruption unit approximates the thermostat 27 to the fixing roller 22 and/or physically separates the fuse element 28 from the power line PL. Therefore, in the case in which the fixing device becomes overheated, power supplied to the heating source is promptly and securely interrupted before deformation or damage of peripheral parts occurs. Thus, the safety of the fixing device may be improved.

Figure 3:
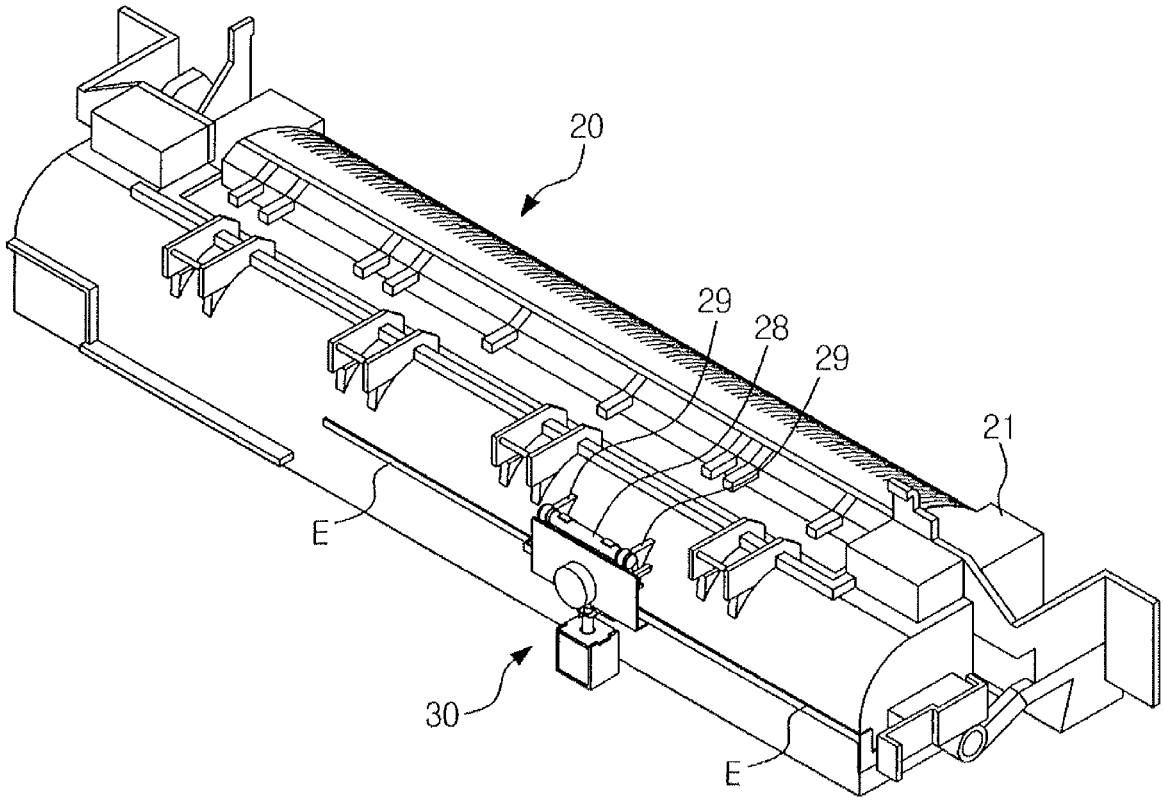
FIG. 3 is a perspective view illustrating an external appearance of the fixing device of the image forming apparatus according to an embodiment of the present general inventive concept.
Figure 4:
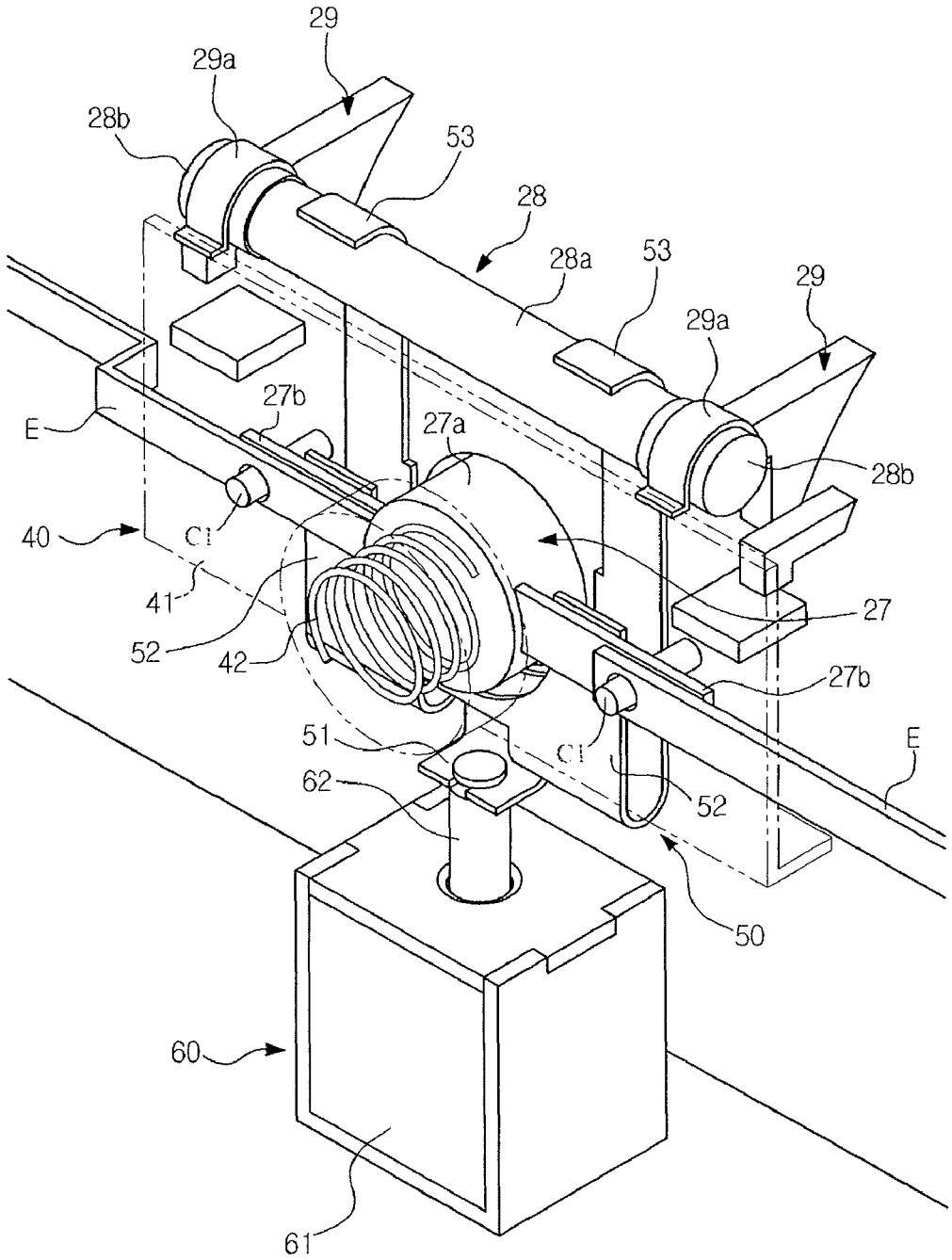
FIG. 4 is a perspective view illustrating the structure of a power interruption unit of the image forming apparatus according to an embodiment of the present general inventive concept.
Figure 5:
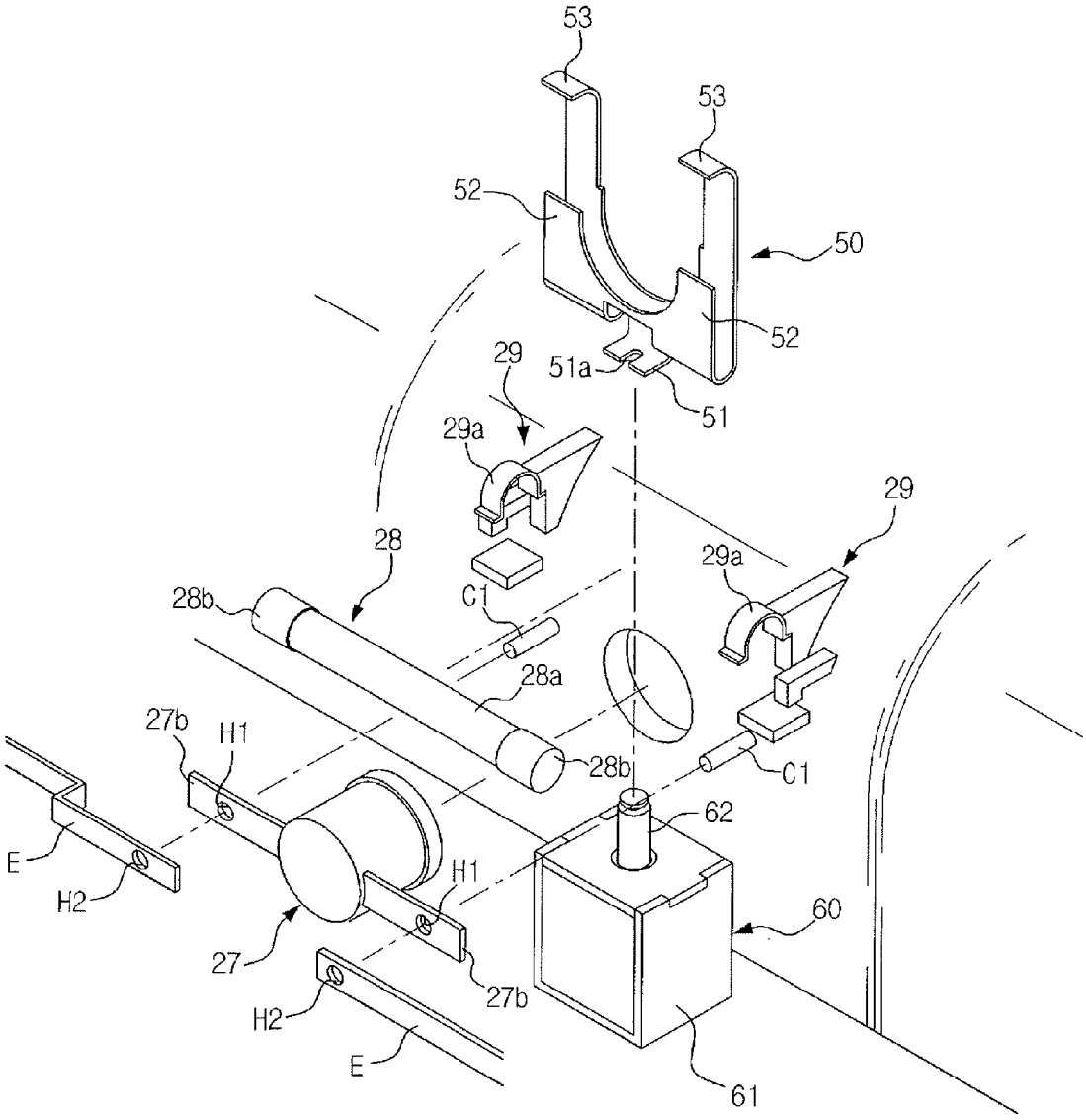
FIG. 5 illustrates an exploded perspective view of the power interruption unit.

FIG. 3 is a perspective view illustrating an external appearance of the fixing device of the image forming apparatus according to an embodiment of the present general inventive concept, FIG. 4 is a perspective view illustrating the structure of a power interruption unit of the image forming apparatus according to an embodiment of the present general inventive concept, and FIG. 5 illustrates an exploded perspective view of the power interruption unit.

Referring to FIGS. 3-5, a power interruption unit 30 of the fixing device 20 may disposed at one side of the fixing device frame 21, near the thermostat 27 and the fusing element 28.

The thermostat 27 may include a thermostat body 27*a* providing the exterior form of the thermostat 27, and connection terminals 27*b* extending from the thermostat body 27*a*. The thermostat body 27*a* may include a pair of connectors connected to the connection terminals 27*b* penetrating inwardly into the thermostat body 27, a fixed contact point connected to an inner end of one connector, a movable contact point connected to an inner end of the other connector, a disc fitted to a part of the thermostat body to cover the inside, a guide pin slidably connected to a center hole of the disc to closely contact the movable contact point, a disc-type bimetal disposed on the upper part of the disc, and a cap covering an upper part of the bimetal, thereby fixing the disc and the thermostat body. These components may be typical components of a conventional thermostat, and therefore a detailed description is not provided. When the bimetal is deformed by heat, the guide pin may be pushed by the bimetal, thereby pushing and disconnecting the movable contact point. The pair of connection terminals 27*b* connected through the fixed contact point and the movable contact point may then be electrically opened. The connection terminals 27*b* of the thermostat 27 may each have a penetration hole H1. Electrodes E in connection with the main power AC may also each have a penetration hole H2. As the penetration holes H1 and H2 are connected by a connector C1, the connection terminals 27*b* of the thermostat 27 and the electrodes E are coupled to one another.

Similar to a general tube fuse, the fuse element 28 may include a fuse body 28*a* formed of a glass tube, and a melting material formed in the center of the fuse body 28*a* to be melted by an over current to therefore become disconnected and cause an interruption in the current. Caps 28*b* may be provided to both respective ends of the fuse body 28*a* to connect the melting material to an external circuit as well as to seal the melting material. The caps 28*b* of the fuse element 28 may be electrically connected, being fitted with holder electrodes 29*a* of fuse holders 29 formed on the fixing device frame 21. The holder electrodes 29*a* may be connected to the main power AC, and also may be electrically connected to the electrodes E in connection with the connection terminals 27*b* of the thermostat 27.

The power interruption unit 30 may include a cover unit 40, a supporting member 50 and an actuator 60.

The cover unit 40 may be disposed so that the thermostat 27 is compressed by an elastic member 42 provide to a cover unit body 41. The cover unit body 41 is illustrated by the broken lines of FIG. 4, and covers various portions of the power interruption unit 30. One side of the elastic member 42 may contact the cover unit body 41 and the other side of the elastic member 42 may contact with a surface of the thermostat body 27*a*, so that the thermostat 27 is biased to one side by the elasticity of the elastic member 42. The elastic member 42 may be formed by, for example, a spring.

The supporting member 50 may include a connecting unit 51, a first supporting unit 52 and a second supporting unit 53.

The connecting unit 51 may be connected with a piston 62 formed at the actuator 60 to be operated in association with the piston 62. The connecting unit 51 may include a connecting recess 51*a* to be connected with an end of the piston 62.

The first supporting unit 52 may support the respective connection terminals 27*b* of the thermostat 27 to prevent the thermostat 27 from moving toward the fixing roller 22. The first supporting unit 52 may be disposed at a position to hinder movement of each connection terminal 27*b*, so that the thermostat 27 can be prevented from being pushed by the elastic member 42 to the fixing roller 22. When the first supporting unit 52 is pulled down through interaction with the actuator 60 (which will be described later), the thermostat 27 may be pushed by the elasticity of the elastic member 42 in the direction of the fixing roller 22 so as to be in closer proximity to the fixing roller 22. In this state, the thermostat 27 may reach the predetermined threshold temperature more quickly due to heat of the fixing roller 22. Therefore, the bimetal in the thermostat 27 may be deformed more quickly and the thermostat 27 may be opened more quickly than usual. Consequently, power supplied to the heating lamp 24 may be interrupted more quickly.

The second supporting unit 53 may support the fuse element 28 so as to separate the fuse element 28 from the fuse holder 29 according to movement of the supporting member 50 by the actuator 60. The second supporting unit 53 may be provided as a pair of supporting members to partly enclose the fuse body 28*a* at a predetermined interval. When the second supporting unit 53 is pulled down, the fuse element 28 is forcibly separated from the fuse holder 29, and the power supply to the heating lamp 24 in the fixing roller 22 is interrupted accordingly.

The actuator 60 may include an actuator body 61 and a reciprocating piston 62. The actuator body 61 may move the piston 62 up and down according to electric signals. For example, the actuator 60 may comprise a solenoid valve. The piston 62 of the actuator 60 may be connected to the connecting unit 51 of the supporting member 50 so that the supporting member 50 can be moved according to the reciprocating movement of the piston 62.

Figure 6:
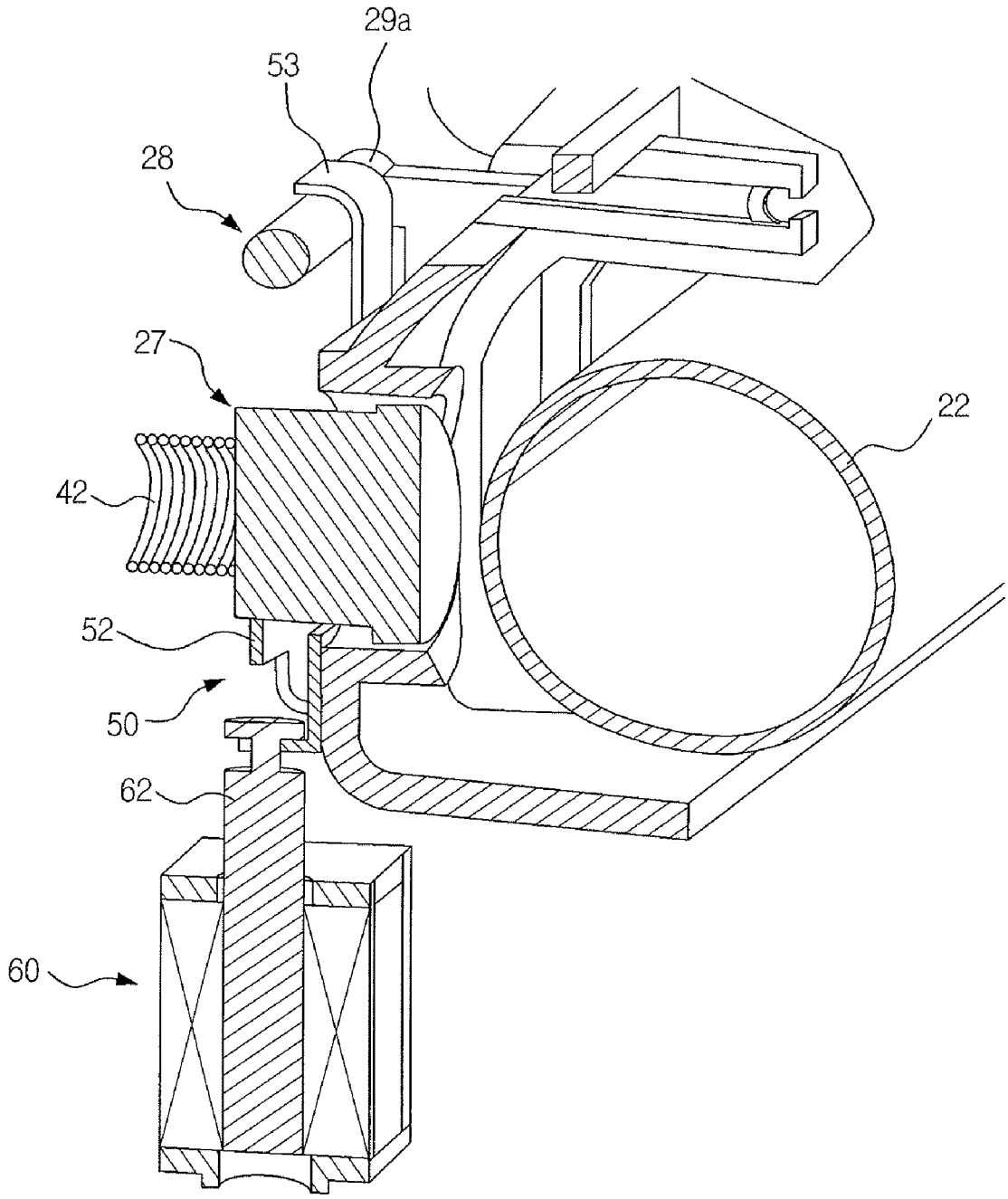
FIG. 6 illustrates a state of the power interruption unit when a surface temperature of a fixing roller of the image forming apparatus is normal.
Figure 7:
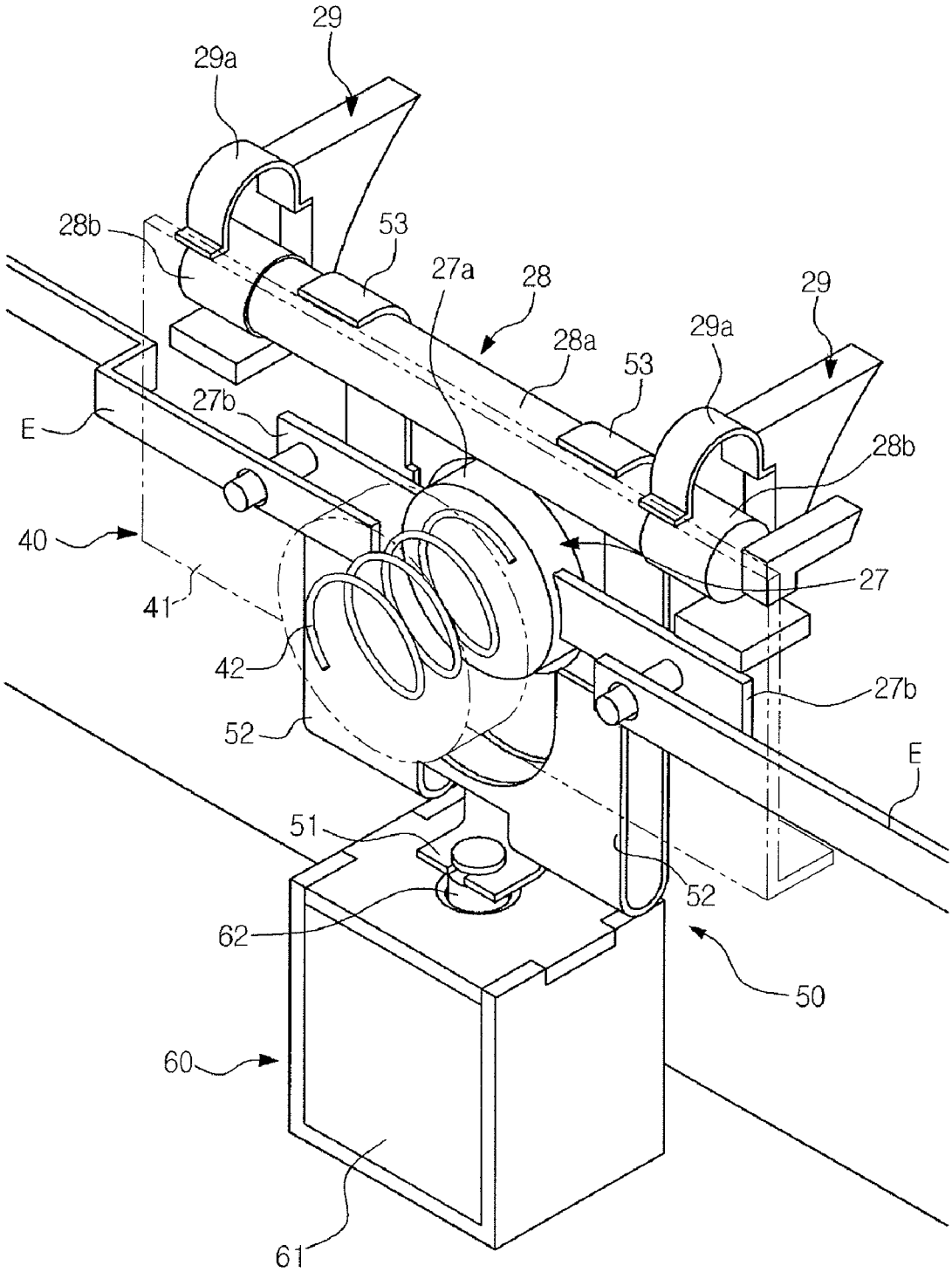
FIG. 7 and FIG. 8 illustrate operation states of the power interruption unit when the fixing roller of the image forming apparatus is overheated.
Figure 8:
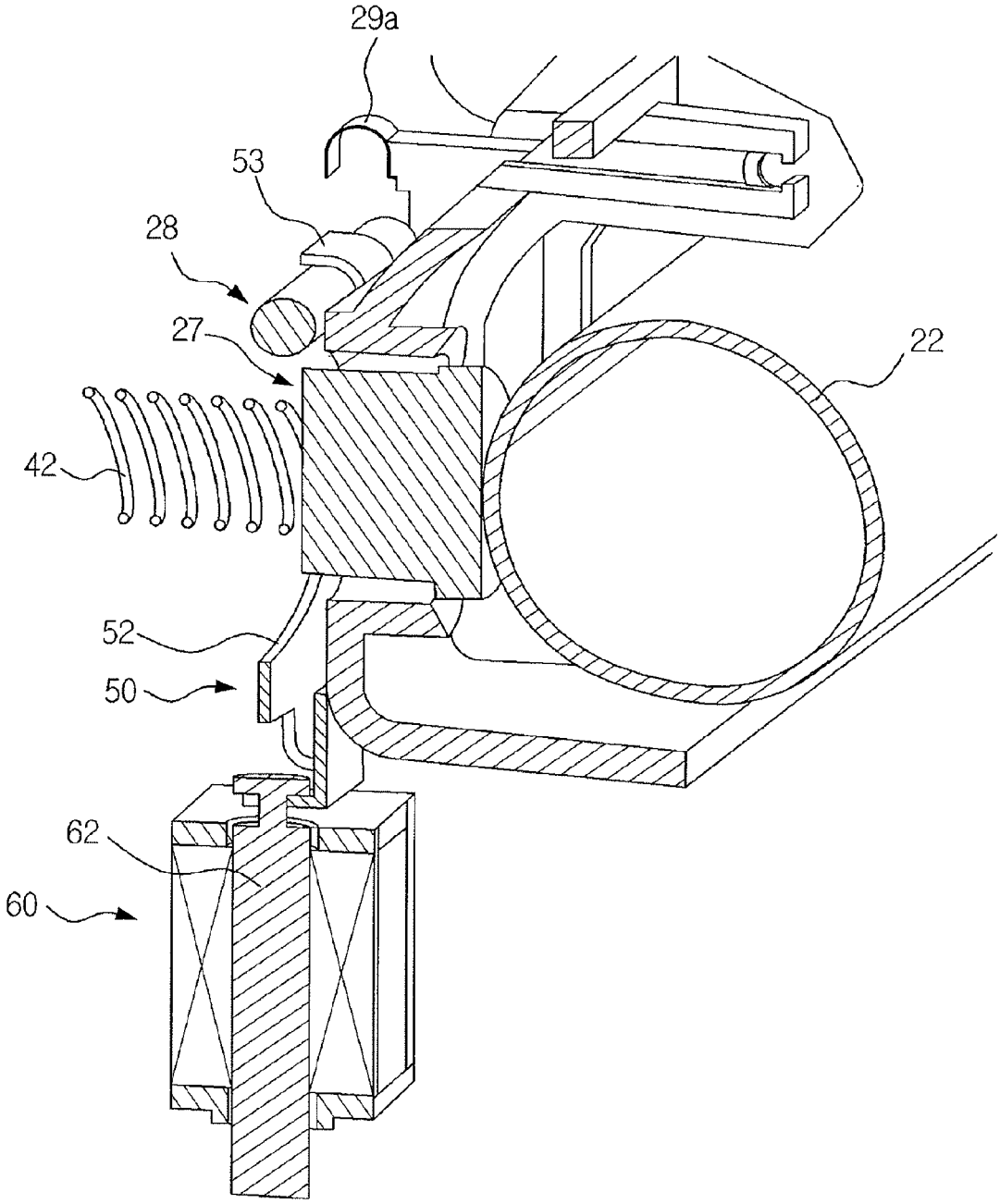

FIG. 6 illustrates a state of the power interruption unit when a surface temperature of a fixing roller of the image forming apparatus is normal, and FIGS. 7-8 illustrate operation states of the power interruption unit when the fixing roller of the image forming apparatus is overheated.

When the piston 62 of the actuator 60 is in an initial position as illustrated in FIG. 6, the thermostat 27 may be maintained at a predetermined distance from the fixing roller 22 by the first supporting unit 52, and the fuse element 28 may be fitted in the fuse holder 29 so as to operate normally.

As illustrated in FIG. 7 and FIG. 8, if the piston 62 of the actuator 60 moves down, the connecting unit 51 of the supporting member 50 may be pulled down. Accordingly, the first supporting unit 52, which in the initial position prevents movement of the thermostat 27 toward the fixing roller 22 due to the contact with the connection terminal 27*b*, is also moved down so as to no longer prevent the thermostat 27 from being pushed by the elastic member 42 toward the fixing roller 22. Therefore, when the first supporting unit 52 is moved down, the thermostat 27 is pushed by the elastic member 42 so as to be more proximate to the fixing roller 22. Additionally, when the piston 62 is moved down so that the connecting unit 51 of the supporting member 50 is pulled down, the second supporting unit 53 may also be moved down. Since the second supporting unit 53 encloses part of the fuse element 28 in this embodiment, the fuse element 28 may be forcibly separated from the fuse holder 29. As a result, the power supply to the heating lamp 24 in the fixing roller 22 may be interrupted.

Thus, when the actuator 60 is in an off state, referred to in this description as the initial state, the thermostat 27 may be maintained at a predetermined distance from the fixing roller 22 by a physical interaction with the supporting member 50 and the fuse element 28 is fitted in the fuse holder 29. When the actuator 60 is turned on, thereby moving the piston 62 and lowering the supporting member 50, the thermostat 27 may move toward the fixing roller 22 and accordingly the fuse element 28 may be separated from the fuse holder 29, thereby interrupting the power supply to the heating lamp 24 in the fixing roller 22.

Figure 9:
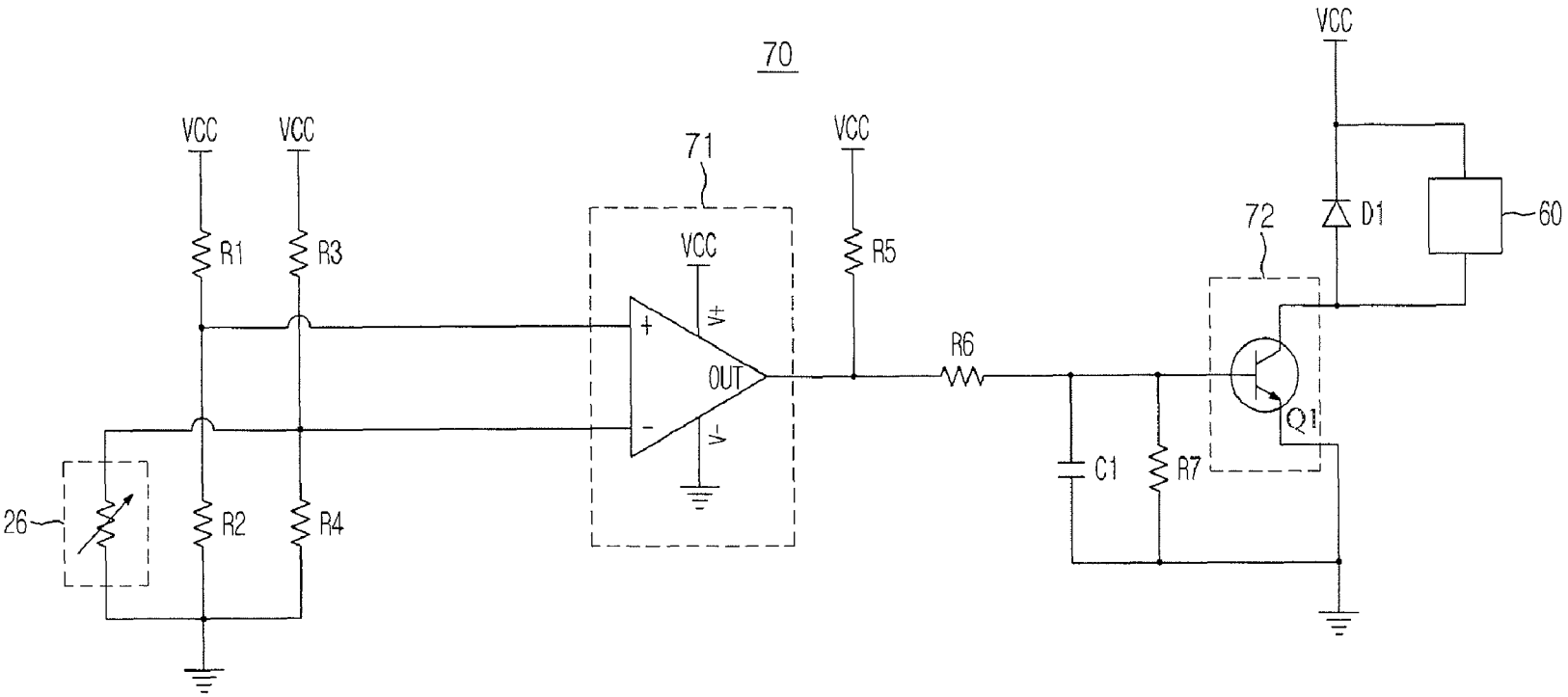
FIG. 9 is a control circuit diagram illustrating control of the operation of the power interruption unit of the image forming apparatus according to an embodiment of the present general inventive concept.

FIG. 9 is a control circuit diagram illustrating control of the operation of the power interruption unit of the image forming apparatus according to an embodiment of the present general inventive concept.

As illustrated in FIG. 9, in the fixing device of the image forming apparatus according to this embodiment of the present invention, the image forming apparatus 30 may include a driving unit 70 to turn the actuator 60 on and off. The driving unit 70 may apply or interrupt power to drive the actuator 60 in accordance with signals output from the thermistor 26. Here, the thermistor 26 may be dedicatedly provided to operate the power interruption unit, in addition to the thermistor 26 measuring the surface temperature. The thermistor 26 may additionally be provided to prevent influences by static electricity of the recording medium or a surge voltage of the power line.

Therefore, the actuator 60 may be operated by the driving unit 70 rather than the controller. In other words, even though the controller may malfunction due to damage at the A/D port caused by static electricity of the recording medium or a surge voltage of the power line, the driving unit 70 may turn on the actuator 60 due to overheating of the fixing roller 22, thereby forcibly interrupting the power being supplied to the heating lamp 24.

The driving unit 70 may include a comparator 71 and a switching element 72. The thermistor 26 may be connected to a "+" terminal of the comparator 71 on one side thereof, and may be connected to a reference potential, for example, grounded, on the other side. Accordingly, a "−" terminal, that is an inverting terminal, of the comparator 71 may be applied with a voltage output by the thermistor 26, whereas the "+" terminal, that is a non-inverting terminal, may be applied with a reference voltage divided by resistances R3 and R4. For example, the thermistor 26 may be a negative temperature coefficient (NTC) thermistor wherein the temperature and the resistance are in inverse proportion to each other, which outputs a lower voltage as the temperature becomes higher.

The comparator 71 may compare the voltage of the "−" terminal output by the thermistor 26 to the reference voltage of the "+" terminal, and may output a low signal when the voltage output by the thermistor 26 is equal to or greater than the reference voltage and a high signal when the voltage output by the thermistor 26 is less than the reference voltage.

The switching element 72 may be electrically connected to an output end of the comparator 71. The switching element 72 may include a transistor Q1 of which a base terminal may be connected to the output end of the comparator 71, an emitter terminal may be connected to the reference potential, and a collector terminal may be connected to the actuator 60.

Therefore, when the output of the comparator 71 is a low signal, the switching element 72 may be turned off, thereby also turning off the actuator 60. When the output is a high signal, the switching element 72 may be turned on, thereby also turning on the actuator 60.

The driving unit 70 may operate as follows. First, when the fixing roller 22 is operating at a normal temperature, the voltage output by the thermistor 26 may be maintained over the reference voltage of the comparator 71, and therefore the comparator 71 may output a low signal. According to the low signal from the comparator 71, the switching element 72 remains turned off, thereby interrupting power supply to the actuator 60. Accordingly, the actuator 60 is maintained in an off state.

If the fixing roller 22 then becomes overheated, the voltage output by the thermistor 26 may be decreased to be lower than the reference voltage of the comparator 71. Therefore, the comparator 71 may output a high signal. According to the high signal, the switching element 72 may be turned on and the actuator 60 may be accordingly supplied with power so as to be turned on. When the actuator 60 is turned on, the thermostat 27 may move nearer to the fixing roller 22 and simultaneously the fuse element 28 may be separated from the fuse holder 29. Therefore, the power supply to the heating lamp 24 may be quickly and securely interrupted.

According to the above-described embodiment, the power interruption unit 30 approximates the thermostat 27 to the fixing roller 22 while forcibly separating the fuse element 28 from the fuse holder 29, so that the power supply to the heating lamp 24 may be interrupted quickly and securely. However, the present invention is not limited to this embodiment.

Figure 10:
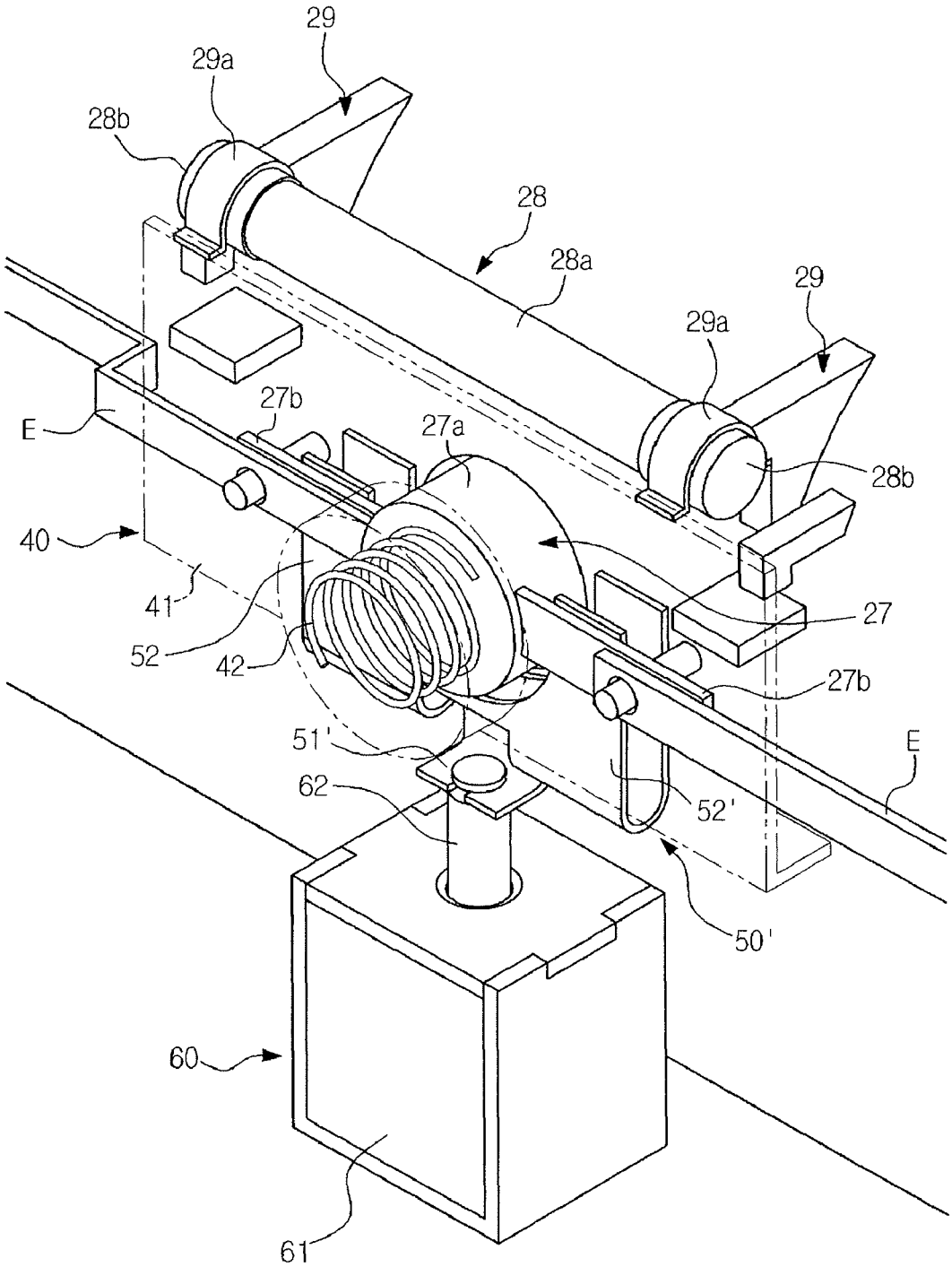
FIG. 10 is a perspective view illustrating a power interruption unit of an image forming apparatus according to another embodiment of the present general inventive concept.

FIG. 10 is a perspective view illustrating a power interruption unit of an image forming apparatus according to another embodiment of the present general inventive concept. As illustrated in FIG. 10, a supporting member 50' of the power interruption unit 30 may include a connecting unit 51' and a supporting unit 52'. In this embodiment, upon overheating of the fixing roller 22, the power interruption unit 30 moves the thermostat 27 nearer to the fixing roller 22 without separating the fuse element 28 from the fuse holder 29.

The connecting unit 51' may be connected to the piston 62 of the actuator 60 to operate in association with the piston 62.

The supporting unit 52' may support the connection terminal 27*b* of the thermostat 27 to prevent the thermostat 27 from moving toward the fixing roller 22. To provide this support, the supporting unit 52' may be disposed at a position to prevent movement of each connection terminal 27*b*, so that the thermostat 27 can be prevented from being pushed by the elastic member 42 to the fixing roller 22. When the supporting unit 52' is pulled down by interaction with the actuator 60, the thermostat 27 may be pushed to a position nearer to the fixing roller 22 by the elasticity of the elastic member 42. In this state, the thermostat 27 may reach the predetermined threshold temperature more quickly due to heat of the fixing roller 22. Therefore, the bimetal in the thermostat 27 may be deformed and the thermostat 27 may be opened more quickly than usual. Consequently, power supplied to the heating lamp 24 may be interrupted more quickly.

Therefore, when the actuator 60 is turned on, the supporting unit 52' may be pulled down and the thermostat 27 may be pushed nearer to the fixing roller 22 by the elastic member 42. Accordingly, the thermostat 27 may be opened more quickly than usual, thereby quickly interrupting the power supply to the heating lamp 24.

Figure 11:
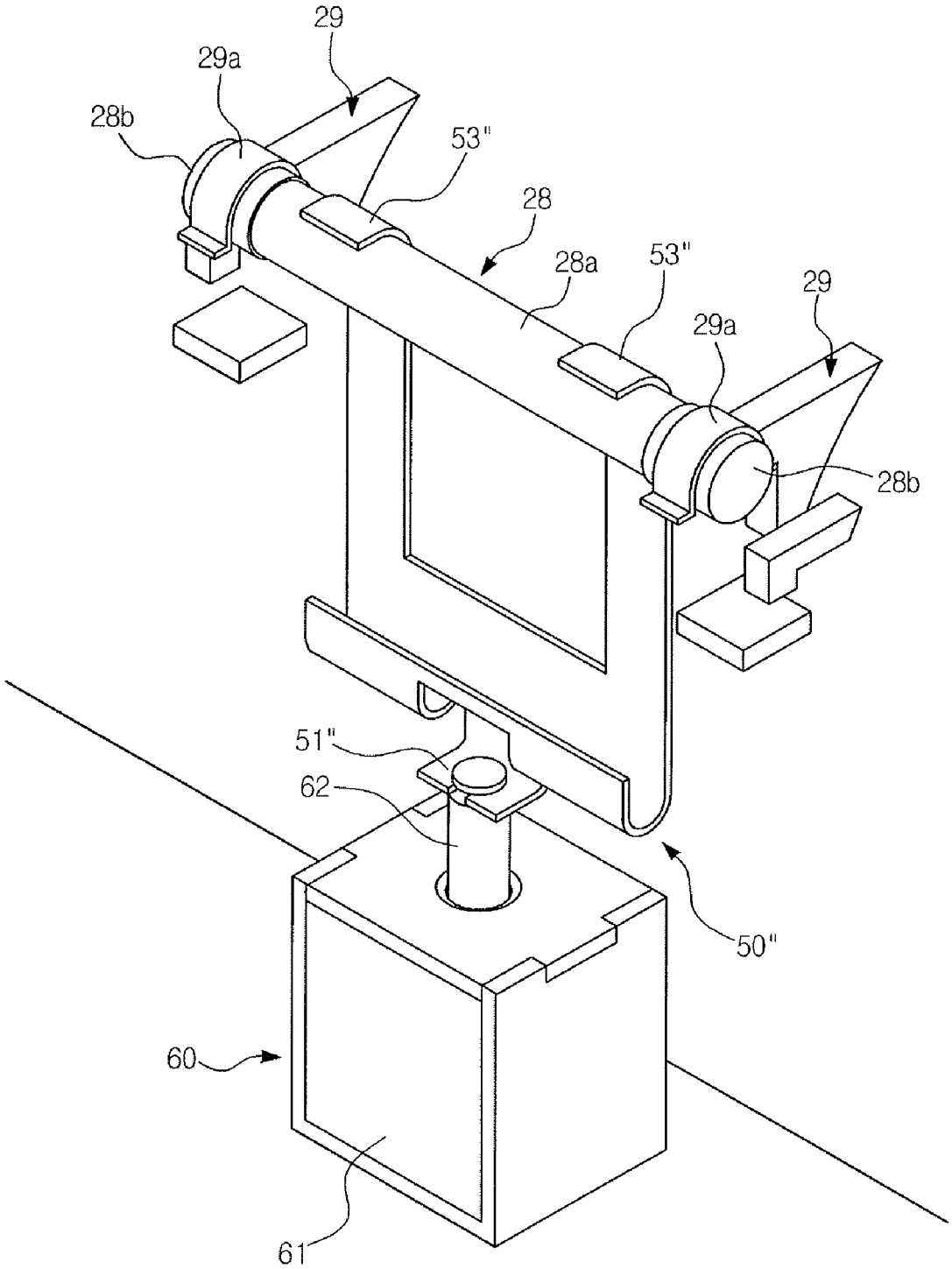
FIG. 11 is a perspective view illustrating a power interruption unit of an image forming apparatus according to yet another embodiment of the present general inventive concept.

FIG. 11 is a perspective view illustrating a power interruption unit of an image forming apparatus according to yet another embodiment of the present general inventive concept. Referring to FIG. 11, a supporting member 50" of the power interruption unit 30 may include a connecting unit 51" and a supporting unit 53". In this embodiment, upon overheating of the fixing roller 22, the power interruption unit 30 may separate the fuse element 28 from the fuse holder 29.

The connecting unit 51" may be connected to the piston 62 to be operated in association with the piston 62 of the actuator 60.

The supporting unit 53" may be provided as a pair of support members to partly enclose the fuse body 28*a* at a predetermined interval. When the supporting unit 53" is pulled down by interaction with the actuator 60, the fuse element 28 may be separated from the fuse holder 29. Accordingly, the power supply to the heating lamp 24 in the fixing roller 22 may be interrupted.

Thus, when the actuator 60 is turned on, the supporting unit 53" may be pulled down by the piston 62 moving down and the fuse element 28 may accordingly be separated from the fuse holder 29. Therefore, the power supply to the heating lamp 24 may be interrupted more securely. In other words, the fuse element 28 may be separated from the fuse holder 29 so as to cut the AC power to the heating lamp 24 without the occurrence of an overcurrent which would melt the material in the center of the fuse element 28, and therefore the fuse element 28 may operate normally upon being returned to its initial position.

Figure 12:
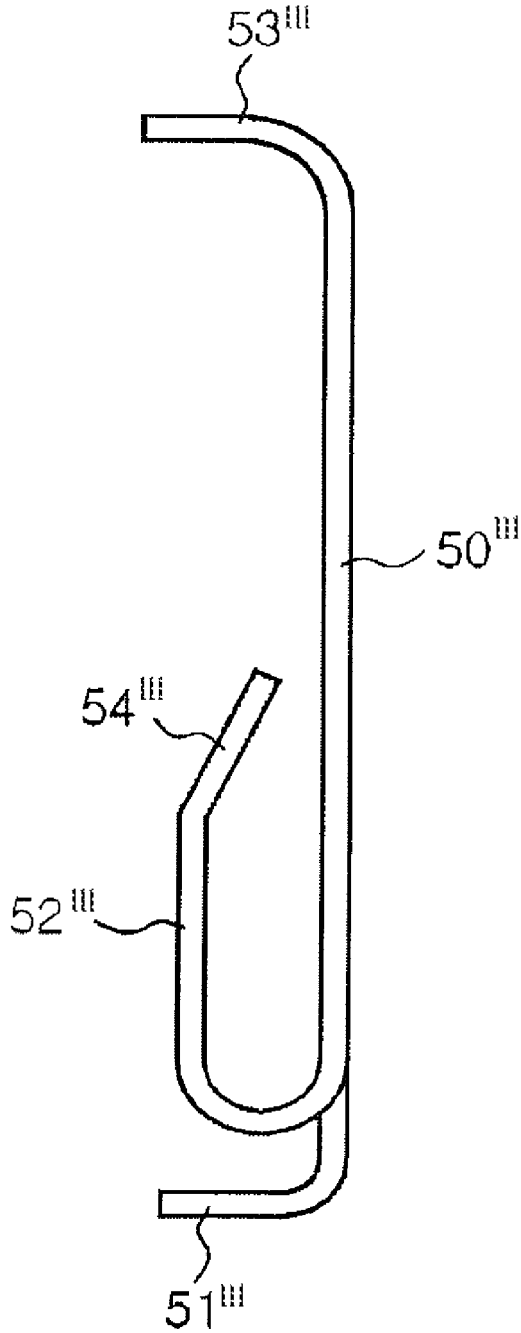
FIG. 12 illustrates a partial side view of a supporting member of a power interruption unit according to still another embodiment of the present general inventive concept.

FIG. 12 illustrates a partial side view of a supporting member of a power interruption unit according to still another embodiment of the present general inventive concept. Referring to FIG. 12, the supporting member 50'" of this embodiment may include a tapered portion 54'" extending from the first supporting unit 52'" in the direction of the fixing roller 22. The tapered portion 54'" may maintain contact with the connection terminal 27*b* of the thermostat 27 during the movement of the thermostat 27 toward the fixing roller 22 upon the actuator 60 being turned on, and also during the movement of the thermostat 27 during the movement of the thermostat 27 away from the fixing roller 22 upon the actuator being turned off. Thus, the movement of the thermostat 27 may be controlled, through this sliding contact between the connection terminals 27*b* of the thermostat 27 and the tapered portion 54'" of the supporting member 50'", more smoothly toward and away from the fixing roller 22.

Although various exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. A fixing device comprising:

a fixing member including a heating source;

a fuse element connected to a power line interconnecting the heating source and a main power;

a thermostat serially connected to the fuse element through the power line to be turned on and off according to a temperature of the fixing member; and a power interruption unit to move the fuse element to separate the fuse element from the power line and move the thermostat toward the fixing member so that power supplied to the heating source is interrupted in response to the fixing member being overheated.

2. The fixing device according to claim 1, wherein the power interruption unit comprises:

a cover member including an elastic member configured to compress the thermostat;

an actuator including a reciprocal piston; and a supporting member to allow the thermostat to move toward the fixing member and to separate the fuse element from a fuse holder in association with movement of the piston.

3. The fixing device according to claim 2, wherein the supporting member comprises:

a connecting unit to connect to the piston;

a first supporting unit to support the thermostat so as to hinder movement of the thermostat; and a second supporting unit to partially enclose and support the fuse element.

4. The fixing device according to claim 3, further comprising:

a temperature sensor to sense the temperature of the fixing member;

wherein the power interruption unit includes a driving unit to operate the actuator in accordance with output signals from the temperature sensor.

5. The fixing device according to claim 4, wherein the driving unit comprises:

a comparator to compare a voltage output by the temperature sensor to a preset reference voltage; and a switching element to switch the power supplied to the actuator on and off in accordance with output signals from the comparator.

6. A fixing device comprising:

a fixing member having a heating source;

a temperature detecting unit to detect a temperature of the fixing member;

a thermostat to control power supplied to the heating source; and a power interruption unit to move the thermostat with respect to the fixing member when the temperature detecting unit detects a predetermined temperature of the fixing device.

7. The fixing device according to claim 6, wherein the power interruption unit comprises:

a cover member including an elastic member configured to compress the thermostat;

an actuator including a reciprocal piston; and a supporting member to allow the thermostat to move with respect to the fixing member in association with movement of the piston.

8. The fixing device according to claim 7, wherein the supporting member comprises:

a connecting unit to connect to the piston; and a supporting unit to support the thermostat so as to hinder movement of the thermostat.

9. The fixing device according to claim 8, further comprising:

a temperature sensor to sense the temperature of the fixing member;

wherein the power interruption unit includes a driving unit to operate the actuator in accordance with output signals from the temperature sensor.

10. The fixing device according to claim 9, wherein the driving unit comprises:

a comparator to compare a voltage output by the temperature sensor to a preset reference voltage; and a switching element to switch the power supplied to the actuator on and off in accordance with output signals from the comparator.

11. The fixing device of claims 6, further comprising:

a driving circuit to drive the power interruption unit independently of a controller of an image forming device in which the fixing device is provided.

12. The fixing device of claim 11, wherein the driving circuit comprises:

a comparator to compare a voltage received from a temperature detector with a reference voltage; and a switching element to drive the power interruption unit according to results received from the comparator.

13. The fixing device of claim 12, further comprising:

a fuse element provided in a power line connected to the heating source;

wherein the power interruption unit disconnects the fuse element from the power line in response to detecting the predetermined temperature of the fixing device.

14. The fixing device of claim 6, wherein the power interruption unit selectively moves the thermostat closer to and farther away from the fixing member.

15. A fixing device comprising:

a fixing member having a heating source;

a fuse element provided in a power line connected to the heating source; and a power interruption unit to move the fuse element to disconnect the fuse element from the power line in response to detecting a predetermined temperature of the fixing device.

16. The fixing device according to claim 15, wherein the power interruption unit comprises:

a cover member including an elastic member configured to compress a thermostat;

an actuator including a reciprocal piston; and a supporting member to separate the fuse element from a fuse holder in association with movement of the piston.

17. The fixing device according to claim 16, wherein the supporting member comprises:

a connecting unit to connect to the piston; and a supporting unit to partially enclose and support the fuse element.

18. The fixing device according to claim 17, further comprising:

a temperature sensor to sense the temperature of the fixing member;

wherein the power interruption unit includes a driving unit to operate the actuator in accordance with output signals from the temperature sensor.

19. The fixing device according to claim 18, wherein the driving unit comprises:

a comparator to compare a voltage output by the temperature sensor to a preset reference voltage; and a switching element to switch the power supplied to the actuator on and off in accordance with output signals from the comparator.

* * * * *